US005134596A

United States Patent [19]

Harris

[11] Patent Number: 5,134,596

[45] Date of Patent: Jul. 28, 1992

[54] ANALOG TIMEPIECE WITH SINGLE HAND FOR DESIGNATING HOURS AND MINUTES

[76] Inventor: Thomas Q. Harris, P.O. Box 7186, Long Beach, Calif. 90807

[21] Appl. No.: 828,196

[22] Filed: Jan. 30, 1992

[51] Int. Cl.[5] ..... G04B 19/04

[52] U.S. Cl. ..... 368/80; 368/228

[58] Field of Search ..... 368/76, 80, 77, 223, 368/228, 232-238

[56] References Cited

U.S. PATENT DOCUMENTS

| | | | |
|---|---|---|---|
| 2,266,183 | 12/1941 | Fergusson | 368/77 |
| 4,991,154 | 2/1991 | Derucchi | 368/76 |
| 5,051,968 | 9/1991 | Calabrese | 368/76 |

*Primary Examiner*—Vit W. Miska

*Attorney, Agent, or Firm*—Charles H. Thomas

[57] ABSTRACT

A timekeeping mechanism, such as a watch or a clock, is provided with a face and a single hand of predetermined length for designating both hours and minutes of time mounted for rotation at the center of the face. A first array of indicia, such as numbers corresponding to hours of time is arranged in an inner circular ring about the center of the face to delineate hourly time intervals. The radius of this inner ring is less than the length of the single hour and minute hand. In addition, indicia corresponding to minutes within an hour are arranged in an outer circular ring on the face in repetitive sets that each reside within the angular hourly intervals. The sets of indicia of minutes are located at a uniform distance from the center of the face corresponding to the length of the single hand. By visually following the indicia at which the single hand is aligned a user is able to ascertain the current time with the hour being designated by the aligned indicia in the inner ring and with the minutes of time past that hour being designated by the indicia in the outer ring.

20 Claims, 2 Drawing Sheets

ANALOG TIMEPIECE WITH SINGLE HAND FOR DESIGNATING HOURS AND MINUTES

BACKGROUND OF THE INVENTION

1. Field of the Invention

The present invention relates to an improvement in an analog timepiece in which both hours and minutes are designated on a circular face by a single hand.

2. Description of the Prior Art

The conventional configuration for the portion of an analog timepiece that imparts information to an observer is well known and has not changed significantly for centuries. The conventional configuration of such a timepiece takes the form of a watch or clock having a face with indicia corresponding to hours of time arranged at uniform angular intervals about a central location on the face. Normally the indicia corresponding to hours on the face of the timepiece delineate, in the aggregate, a twelve hour period. Each hourly interval extends an angular distance of thirty degrees as measured from the center of the face of the timepiece. The twelve angular intervals for the hours from one through twelve cover the entire 360 degree circumference of the face of the timepiece.

According to the conventional configuration of analog timepieces the minutes within an hour are either not indicated by indicia at all, or are indicated by indicia arranged in a circular pattern at the same distance from the center of the face of the timepiece as the indicia corresponding to hours of time. With this conventional practice two different hands are mounted at the center of the face of the timepiece and are driven at different angular speeds in a clockwise direction. The two different hands extend radially out from the center of the face of the timepiece and are mounted on different drive mechanisms at the center, one atop the other.

According to convention, the shorter of the two hands is driven at the rate of one complete revolution every twelve hours, thereby pointing to a specific hourly interval within a total twelve hour period for only one hour during that twelve hour period. The longer hand of the timepiece, on the other hand, is driven at the rate of one complete 360 degree revolution every hour, and therefore makes twelve complete revolutions during the twelve hour period in which the shorter hand of the clock makes a single revolution. Thus, there are two entirely different frames of reference associated with the manner of observing the passage of time in hours and minutes in the conventional analog timepiece configuration.

To perceive the time of day using a conventional timepiece, an observer mentally associates the position of the shorter of the two hands relative to the face of the timepiece with a particular hour of the day. This association is performed with respect to a reference point which is the top of the face of the timepiece as viewed by the observer. Therefore, when the shorter of the two hands is angularly displaced 90 degrees from the top of the face and is pointed toward the indicia associated with the third hourly interval, the observer mentally recognizes that the hour is three o'clock in a twelve hour time period. Similarly, when the shorter of the two hands is angularly displaced 120 degrees clockwise from the top of the face of the timepiece, the observer recognizes that the hour is four o'clock in a twelve hour time period.

However, to perceive the minutes between two sequential hourly indicia the observer must make a change in the frame of reference. Thus, if the shorter of the two hands is angularly displaced clockwise from the top reference point between 180 degrees and 210 degrees and the longer of the two hands is angularly displaced 60 degrees, the observer must make a determination of hours and minutes using two completely different frames of reference. The position of the shorter of the two hands must be recognized as indicating some time between the sixth and seventh hour of the time period, while the position of the longer of the two hands must be recognized as indicating some fraction of a one hour interval.

In the foregoing example, the position of the longer of the two hands at a 60 degrees clockwise displacement relative to the top reference point must be considered as a fraction of the entire 360 degree pattern of a single array of indicia, which is a fraction of one sixth. Since there are sixty minutes in an hour, this fraction equates to a period of ten minutes. These combined determinations place the time at ten minutes after the hour of six. Thus, the observer utilizes the entire 360 degree circumference of the array of indicia on the timepiece in two different ways. That circumference first symbolizes an entire twelve hour period, when considered with reference to the shorter of the two hands. However, it also symbolizes a one hour period when considered with reference to the longer of the two hands.

Timepieces are available in which the circumference of the timepiece face corresponds to a twenty four hour period, rather than a twelve hour period. In such timepieces the frame of reference in determining minutes within an hour remains the same as for twelve hour timepieces, but each hourly increment corresponds to an angular travel of fifteen degrees, rather than thirty degrees in determining hours within the twenty four hour period. The principles governing the different frames of reference for determining the hours and minutes are the same, however, whether the entire circumference of the face of the conventional timepiece is considered to be twenty four or twelve hours.

SUMMARY OF THE INVENTION

The present invention involves an analog timepiece which differs in construction from prior analog timepieces due to a difference in the conceptual reference system employed. Specifically, according to the present invention a single frame of reference is employed to ascertain both hours and minutes within hourly increments. Like conventional timepieces the frame of reference for ascertaining an hour of a time period, such as a twelve hour time period, involves an observation of the position of a rotating timepiece hand relative to a reference location, such as the top of the face of the timepiece. Hourly increments are indicated by hourly indicia located at uniform intervals at positions radially displaced from the center of the face of the timepiece in an inner circular ring about the center. Unlike conventional analog timepieces, however, the minutes within each hour are determined by the same radially extending hand of the timepiece and by indicia located in a second array in an outer circular ring about the center of the timepiece face. The indicia of minutes are located at a distance from the center greater than the indicia denoting hours.

The indicia corresponding to minutes within an hour are arranged in repetitive sets wherein each of the sets resides within a separate one of the hourly intervals. These repetitive sets are located a uniform distance from the center of the face of the timepiece. This distance is adjacent to the end of the single hand that designates both hours and minutes of time and is a greater distance from the center than the distance at which the indicia corresponding to hours of time are located.

To utilize the timepiece of the invention, a user looks at the single hand that designates both hours and minutes and visually follows that hand outwardly from the center of the face of the timepiece. The hour of the overall time period associated with a complete revolution of the hand of the timepiece is denoted by the indicia over which the hand passes visually proceeding radially outwardly from the center of the face. Preferably, the single hour and minute hand is formed with an annular loop therein so that the hour indicia aligned with the hand is not obscured. The user then continues to visually follow the linear hand radially outwardly from the center to the periphery of the face of timepiece, where the indicia corresponding to minutes within an hour are located. The tip of the hand will point to an indicia of minutes. A user is thus able to quickly and easily ascertain the time with reference to indicia which are designated by a single hand on the timepiece.

Use of the timekeeping device of the invention will simplify the learning process for young children to learn to tell time. With conventional timekeeping devices children, at a very young age, are able to tell the hour designated by the small hand of a conventional timepiece almost as soon as they learn to read numbers. However, the necessary change in the frame of reference in determining minutes in addition to hours currently mystifies and eludes children for quite some time. By employing timepieces according to the present invention children will be able to ascertain time accurately at a much earlier age than is presently possible for the great majority of youngsters.

In one broad aspect the present invention may be considered to be an improvement in a timekeeping mechanism in which a rotary drive element projects from a face and is driven at a constant angular velocity relative thereto. The improvement is comprised of a single hand of predetermined length for designating both hours and minutes of time. This hand is attached to the drive element and extends radially therefrom. A first array of indicia corresponding to hours of time are arranged in an inner circular ring about the drive element at uniform angular intervals delineating hourly intervals and at a first uniform distance less than the predetermined length of the hand. The timekeeping mechanism of the invention also employs indicia corresponding to minutes within an hour arranged on the face of the timepiece in an outer circular ring in repetitive sets that each reside within a separate one of the angular hourly intervals. The indicia in the second array are located at a second uniform distance from the rotary drive element greater than the first distance. The second distance preferably corresponds to the length of the hand that designates both hours and minutes.

A timekeeping mechanism according to the invention is preferably comprised of a radially extending reference indicia formed on the face of the timepiece and defining a reference hour of time. Typically this reference indicia is a straight line imprinted or inscribed on the face of the timekeeping mechanism. This reference line extends from the center of the face radially outwardly, upwardly to the top of the timekeeping mechanism as viewed by an observer. This reference indicia normally denotes the hour of twelve o'clock, since the indicia of twelve o'clock is customarily located at the top of a conventional timekeeping mechanism.

Preferably also there are a plurality of indicia within the first array of indicia for each hour of time. That is, the indicia for each hour of time is printed not only once, but several times in an arcuate path that extends through the annular interval on the face of the timekeeping mechanism associated with commencement of that hour and termination thereof when the next sequential hour begins. Also, a loop is preferably formed in the single hand for designating hours and minutes. This loop is formed at a distance along the single hand from the drive element that is equal to the first distance at which the first array of indicia are located. In this way the loop passes across and frames each indicia in the first array with the passage of time. By employing a plurality of indicia for each hour, some indicia identifying that hour is either wholly or partially visible through the loop in the hand throughout that hour until the commencement of the next sequential hour. Preferably also, the most counterclockwise indicia for each hour of time is highlighted on the face of the timekeeping mechanism. The highlight may involve printing the first indicia at the beginning of the interval for that hour in larger print, in a different color, within a circle on the face of the timekeeping mechanism, or by some other means for highlighting.

Because so many more minutes than hours are represented in the second array of indicia there will not normally be an indicia for each and every minute within the total time period represented by one revolution of the single hand about the center of the face of the timekeeping mechanism. If the single hand for designating hours and minutes travels through one complete revolution about the center of the face over a twelve hour period, the indicia in the second array must represent seven hundred twenty sequential minutes. Because of the great number of minutes in a twelve hour time period, it would be possible to represent each individual minute in the second and outermost ring of indicia at the extremity of the hand of the timepiece only if each such indicia were confined within a space of one half of one degree of rotation.

The space available for representation of minutes in the outer ring is greater than it would be in the inner ring. This is because the indicia indicative of minutes within an hour are located at a greater distance from the center than are the indicia indicative of hours. Nevertheless, it is normally neither practical nor desireable to provide a separate indicia for each and every minute in a twelve hour period. Also, it is not particularly desireable to represent all indicia corresponding to minutes by numerical indicia. To the contrary, the indicia corresponding to minutes within an hour preferably include a numerical indicia only for each quarter hour and also preferably include non-numerical indicia for each five minute interval.

The non-numerical indicia may take the form of radial line segments in the outer, circular ring, extending radially inwardly from and between the numerical indicia for the fifteen minute intervals on the face of the timepiece. A twelve hour timepiece constructed in this manner requires only one hundred forty-four separate non-numerical indicia in the outer ring corresponding to minutes, and only forty-eight numerical indicia. By abbreviating the number and nature of indicia corresponding to minutes in this manner the indicia for minutes that are provided are much more legible than would otherwise be the case.

While but a single hand is provided to designate both hours and minutes on a timekeeping mechanism according to the invention, it may be desirable to provide the timepiece with a conventional secondhand. In such an embodiment the timekeeping mechanism must be provided with a secondary drive element at the center of the face which is driven at a speed thirty-six hundred times that of the primary rotary drive element for the hour and minute hand.

The timepiece of the invention may take the form of a wristwatch, wall clock, or other conventional form of timepiece. In one embodiment of the invention it is advantageous for the rotary drive element and the face to be mounted together on a carriage located atop a base. These elements of the timekeeping mechanism are thereby movable together with the carriage, and the carriage is movable in rotation relative to the base. The embodiment is particular advantageous to travelers for ascertaining not only the time in the time zone where they normally reside or are located, but also in different time zones at temporary destinations.

The invention may be described with greater clarity and particularity with reference to the accompanying drawings.

DESCRIPTION OF THE EMBODIMENTS

Figure 1:
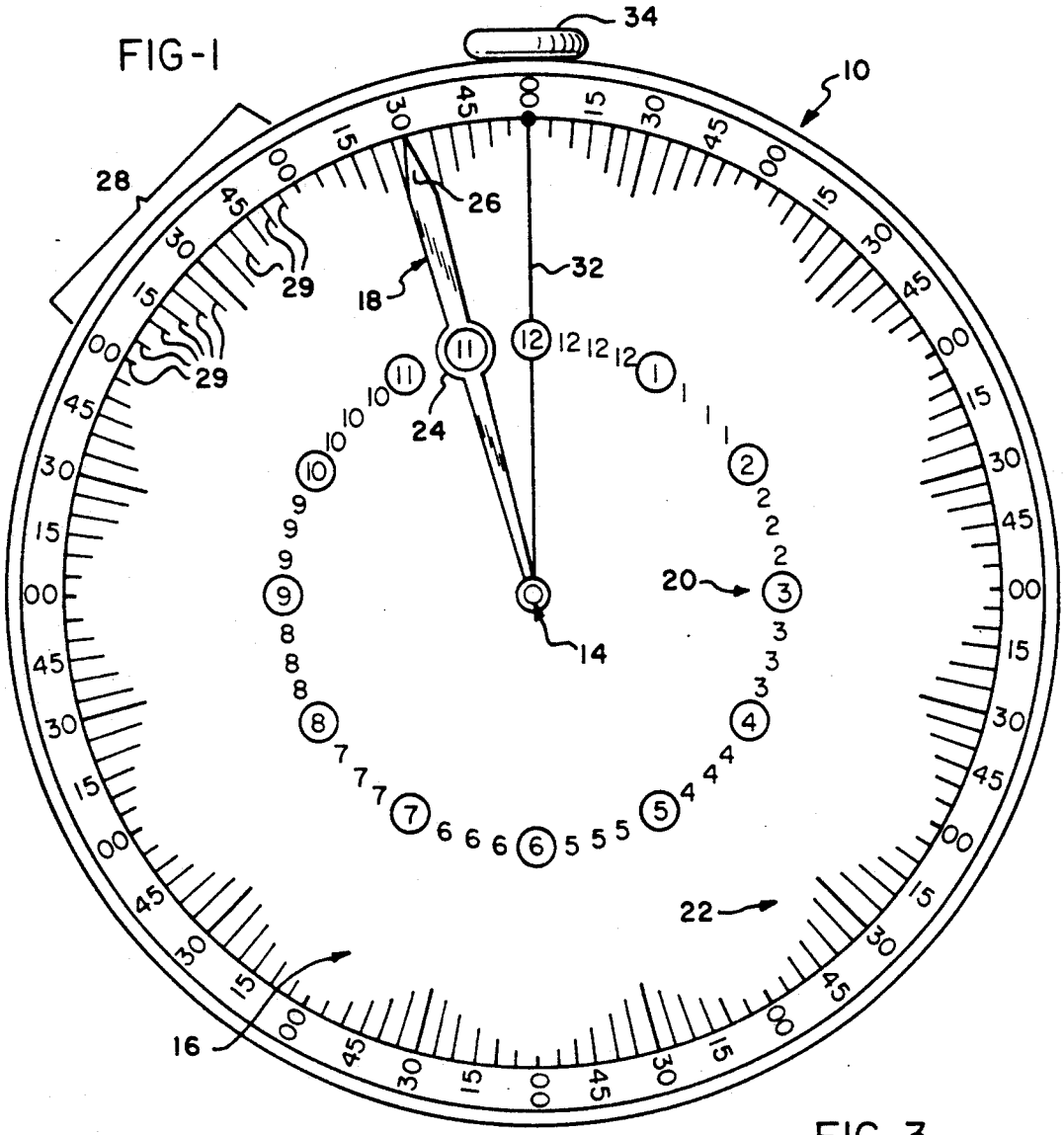
FIG. 1 is a top plan view showing one preferred embodiment of the invention in magnified form.
Figure 2:
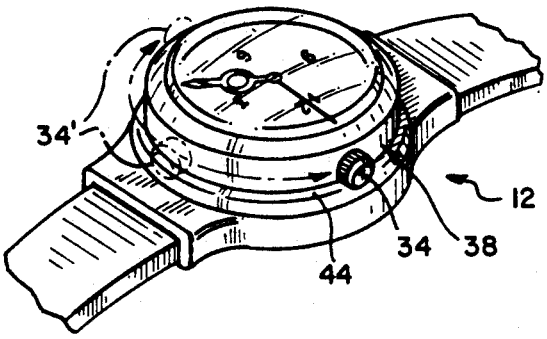
FIG. 2 is a perspective view of the embodiment of FIG. 1 shown mounted as a wristwatch.

FIG. 1 illustrates an analog timepiece or chronometer 10 constructed as part of a wristwatch assembly indicated generally at 12 in FIG. 2. Like conventional wristwatches and other timepieces, the analog timepiece 10 has a central rotary drive element 14 which is mounted for rotation perpendicular to and at the center of a flat, circular watch face 16. The rotary drive element 14 is a central primary drive element and is driven at a constant angular velocity relative to the face 16. In the embodiment illustrated in FIGS. 1-3, the primary drive element 14 rotates in a clockwise direction at a speed of one revolution during each 12 hour period.

Unlike conventional analog timepieces, the improved analog timepiece of the invention is comprised of a single hour and minute hand 18 that is mounted on the drive element 14 and extends radially therefrom across the face 16. A first array of numerical indicia 20 corresponding to hours of time are arranged radially about the drive element 14 at an equal distance therefrom in a circular inner ring that has a radius less than the length of the single hour and minute hand 18. The indicia in the first array 20 are arranged circumferentially about the central primary drive element 14 at uniform angular intervals to define hourly increments. The analog timepiece 10 is also provided with a second array 22 of indicia. The indicia within the array 22 lie in an outer, circular ring about the central drive element 14 and correspond to minutes of time. The indicia for minutes in the array 22 are arranged repetitively in twelve equal sets at equal angular intervals centered on the drive element 14. The indicia in the second, outer array of indicia are located at a distance from the central drive element 14 which is greater than the distance of the first array 20 of indicia from the central drive element. The indicia in the second array 22 are arranged in sets, the indicia within each set being repeated within each angular increment corresponding to each hourly increment. The single hour and minute hand 18 extends radially beyond the indicia in the array 20 corresponding to hours and out to the indicia in the array 22 corresponding to minutes. The single hand 18 thereby designates both an hour of time and minute elapsed within the designated hour and the next sequential hour.

As illustrated in FIG. 1 there are a plurality of numerical indicia in the first array 20 for each hour of time. Specifically, there are four numerical indicia for the number "1", four for the number "2", and so forth up through four indicia for the number "12". The single hour and minute hand 18 is formed with a loop 24 therein at a length therealong equal to the distance of the first array 20 of indicia from the central drive element 14. The loop 24 is of circular, annular configuration and defines a central opening therethrough, whereby the loop 24 frames an indicia for the hour as it initially reaches that hour and until i reaches the next hour.

In the example illustrated in FIG. 1, the loop 24 frames the third of four indicia denoted by the number "11" when the time is eleven thirty, either am or pm. Because there are a plurality of indicia for each hour in the indicia array 20, the hand 18 always passes radially across an indicia for an hour after initially reaching the hour and before reaching the next hour.

As illustrated in FIG. 1 the most counterclockwise of each of the indicia in the array 20 is highlighted on the face 16 by imprintation of the circle thereabout. Therefore, for example, at exactly the hour of eleven o'clock the hand 18 resides in registration with the most counterclockwise, circled indicia 11 and frames that indicia. At that time the tip 26 of the hand 18 points at the minute designated "00" which is aligned with the most counterclockwise of the indicia for the hour "11". As time passes, the single hour and minute hand 18 rotates in a clockwise direction past the initial, circled indicia "11". However, because there are a plurality of indicia "11" in the thirty degree angle between the most counterclockwise indicia "11" and the most counterclockwise indicia "12", the loop 24 will always frame at least a portion of an indicia "11" from the commencement of the eleventh hour until the commencement of the twelfth hour.

While the indicia in the first, inner array 20 corresponding to numerical hours delineate 12 hourly increments, the indicia in the outer array 22 corresponding to minutes designate twelve five minute intervals within each of the thirty angular degree hourly increments. That is, for example, the set of indicia of minutes indicated collectively at 28 is comprised of twelve linear line segments marked on the face 16 of the timepiece 10 and extending radially inwardly adjacent the numerical indicia in the outer ring of the indicia array 22 toward the central drive element 14. These non-numerical indicia in the set 28 are each indicated by the reference designation 29. Each indicia 29 designates a five minute time interval within the thirty angle degree hourly increment within which it is located.

The indicia 29 increase in length from the start of the hourly interval for ten o'clock where the first non-numerical linear indicia 29 resides in radial alignment with the numerical indicia "00" to the longest non-numerical indicia 29 which is aligned with the numerical indicia "30". Continuing in a clockwise direction the non-numerical indicia 29 then decrease in length. There are a total of one hundred forty-four non-numerical indicia within the second array 22 of indicia corresponding to minutes. These non-numerical indicia are located three and three quarters angular degrees apart from each other. There are twelve of the non-numerical minute indicia 29 within the set 28 of the indicia array 22, as well as in every other set in the array 22.

In addition to the non-numerical indicia 29, each indicia set within the indicia array 22 includes numerical indicia for each fifteen minute interval. As illustrated, the set 28 for the hourly interval from ten o'clock to eleven o'clock includes four numerical indicia for the four fifteen minute time intervals within that hourly interval which are designated, respectively as "00", "15", "30" and "45". All of the other indicia sets within the array 22 likewise include the same four numerical indicia.

Preferably the analog timepiece 10 includes a radial linear reference indicia indicated at 32. This reference indicia 32 is a thick, linear line printed on the timepiece face 16. The indicia 32 extends from the central drive element 14 radially outwardly to the top of the timepiece 10 at which a crown 34 is located external to the face 16. The radial linear reference indicia 32 has a gap therewithin at the same distance from the central drive element 14 as the loop 24. The linear segments of the radial indicia 32 bounding this gap intersect the circle which circumscribes the most counterclockwise of the indicia designating the hour of twelve o'clock in the array of indicia 20.

The crown 34 is located in alignment with the initial, most counterclockwise indicia denoting the hour of "12" in the first inner indicia array 20. This initial, circled indicia "12" in the first array 20 denotes a reference hour. The crown 34 and this initial, reference indicia "12" denoting the hour of twelve o'clock resides in linear alignment with the linear, radial reference indicia 32 and the central drive element 14 of the face 16.

To utilize the analog timepiece 10 a viewer can tell the hour and minute of time by viewing the single linear hand 18. The viewer first looks at the portion of the hand 18 proximate the central drive element 14 and visually follows the alignment of the hand 18 radially outwardly therefrom. When the hand 18 is at the position illustrated in FIG. 1, the viewer observes that the loop 24 frames the third of four indicia in the inner array 20 forming the number "11", counting in a clockwise direction. The viewer then visually follows the continuation of the single hand 18 radially out to the tip 26 thereof. The tip 26 points to one of the numerical indicia "30". This particular numerical indicia "30" indicates the thirtieth minute past the eleventh hourly increment. Thus, the observer can readily discern that the time is eleven thirty. In all cases the single linear hand 18 will designate both the hour of time and the number of minutes which have elapsed since the commencement of that hour within that hourly interval.

Figure 3:
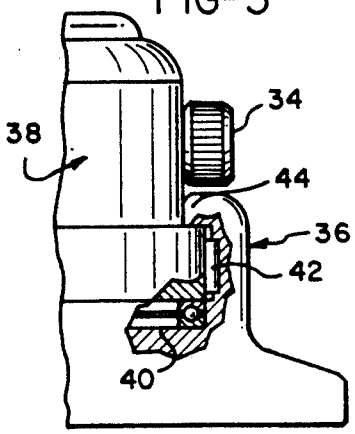
FIG. 3 is a side elevational detail partially broken away, showing a portion of the timepiece of FIG. 2.

The analog timepiece 10 is comprised of a base 36 and a carriage 38 mounted atop the base 36. The carriage 38 is held to the case 36 by means of an overhanging lip 44 on the base 36. The carriage 38 is rotatable relative to the base 36 by means of a ball-bearing race indicated at 40 and a plurality of roller bearings 42 as indicated in FIG. 3. The carriage 38 thereby smoothly rotates relative to the base 36 about an axis that is coincident with the axis of the central drive element 14. The carriage 38 thereby carries the crown 34, the face 16 and the central drive element 14 therewith. Rotation of the carriage 38 relative to the base 36 alters the orientation of the crown 34 and the reference indicia 32 relative to the base 36.

By mounting the carriage 38 in a rotatable fashion on the base 36, a user is able to alter the orientation of the crown 38 and reference mark 32 relative to the base 36. This is useful for travelers who wish to keep track of both local time as Well as time at their place of origin. For example, and as illustrated in solid lines in FIG. 2, a user will usually orient the carriage 38 relative to the base 36 with the crown 34 at the top the base 36. However, if the user travels to a different time zone it may be desirable to rotate the carriage 38 so that the analog timepiece 10 can be utilized to keep track of time both in the time zone or origin and a time zone in which the user may be temporarily located.

If, for example, a user travels to a time zone which is three hours ahead of the time zone in which the user commenced the journey, the user may wish to rotate the carriage 38 so that the crown 34 is rotated ninety degrees in a clockwise direction to the position indicated at 34' in FIG. 2. This will not alter the position of the single hand 18 relative to the reference indicia 32 nor to the indicia in the first and second indicia arrays 20 and 22. Thus, as illustrated in the example of FIG. 2, the hand 18 will j continue to designate a specific time of four o'clock, for example if one visually reads the indicia in the arrays 20 and 22 which are designated by the hand 18.

However, if the carriage 38 is rotated ninety degrees clockwise relative to the base 36, the orientation of the hand 18 relative to the base 36 will be advanced by an amount indicative of three hours. That is, although the hand 18 continues to designate a time of four o'clock with reference to the indicia on the face 16 of the timepiece 10, the position of the hand 18 relative to the base 36 will reside at a position which the user would customarily associate with the hour of seven o'clock, were the crown 34 in the normal position at the top of the base 36. A user can thereby keep track of both local time as well as time in the time zone at which the user customarily uses the timepiece 10.

Figure 4:
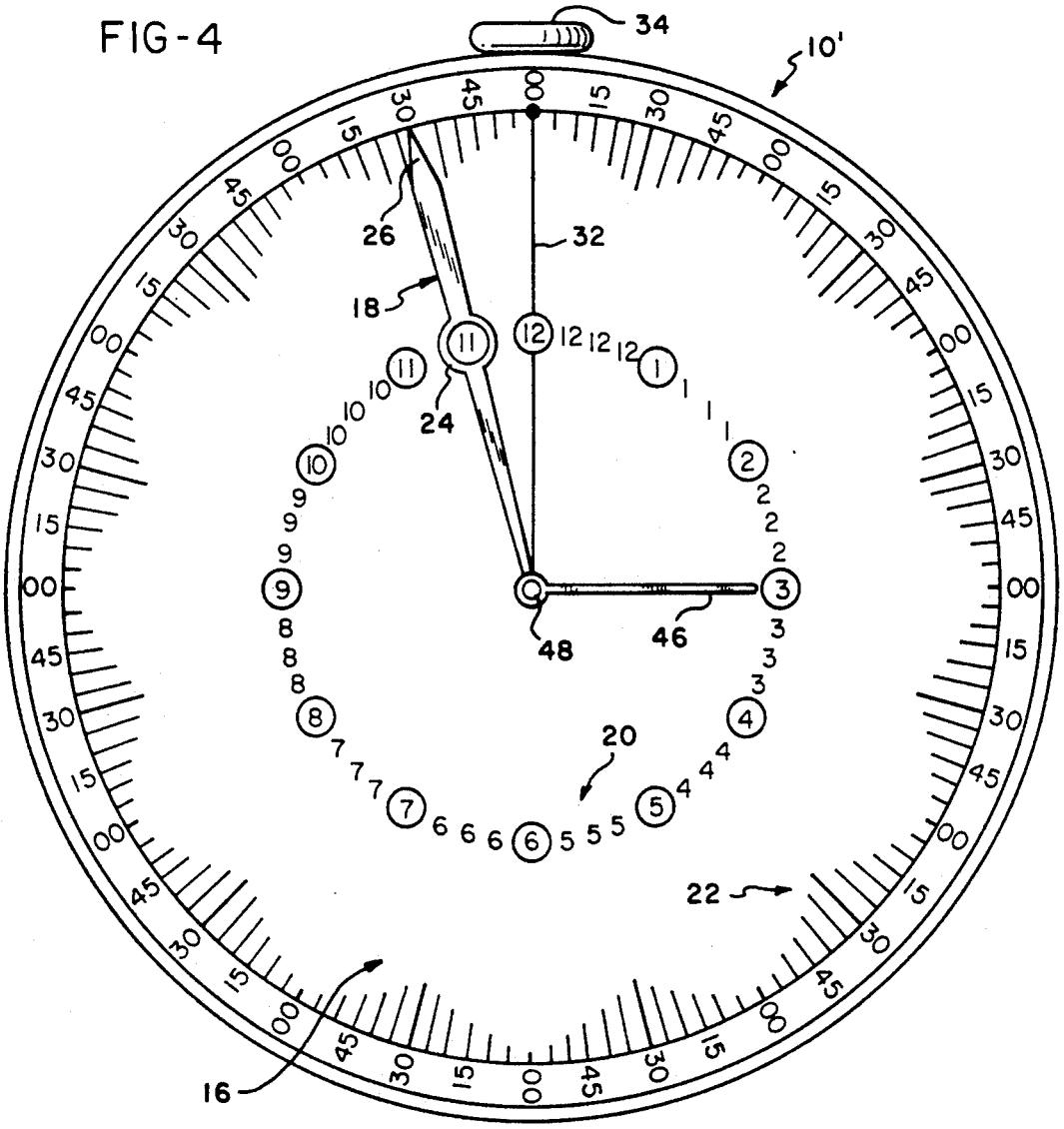
FIG. 4 is a top plan view of an alternative embodiment of the invention to that of FIG. 1, also shown in magnified form.

FIG. 4 illustrates another embodiment of the invention employing a hand 46 for designating seconds of time. The analog timepiece 10' differs from analog timepiece 10 only in that it is formed with a secondary drive member 48 that rotates relative to the primary drive member 14 at thirty-six hundred times the speed of the drive member 14. A second hand 46 indicative of seconds of time is coupled to the secondary drive element 48 and extends therefrom radially across the face 16. The timepiece 10' can thereby be utilized to tell time in seconds in a conventional manner, although the minutes and hours are ascertainable in the manner a described in connection with the analog timepiece 10.

Undoubtedly, numerous other variations and modifications of the invention will become readily apparent to those familiar with analog timepieces. For example, a timepiece according to the invention may be provided with an alarm or other optional features with which a conventional chronometer may be equipped. Accordingly, the scope of the invention should not be construed as limited to the specific embodiments depicted and described herein, but rather as defined in the claims appended hereto.

We claim:

1. In a timekeeping mechanism in which a rotary drive element projects from a face and is driven at a constant angular velocity relative thereto, the improvement comprising a single hand of predetermined length for designating both hour and minutes of time attached to said drive element and extending radially therefrom, a first array of indicia corresponding to hours of time arranged in an inner circular ring about said drive element at uniform angular intervals delineating hourly intervals and at a first uniform distance less than said predetermined length of said hand, and a second array of indicia corresponding to minutes within an hour arranged in repetitive sets that each reside within a separate one of said angular hourly intervals and at a second uniform distance from said rotary drive element greater than said first distance.

2. A timekeeping mechanism according to claim 2 further comprising a radially extending reference indicia formed on said face and defining a reference hour of time.

3. A timekeeping mechanism according to claim 2 further comprising a plurality of indicia within said first array for each hour of time and wherein a loop is formed in said single hard at a distance therealong from said drive element equal to said first distance, whereby said loop passes across and frames each indicia in said first array with the passage of time.

4. A timekeeping mechanism according to claim 3 wherein the most counterclockwise indicia for each hour of time is highlighted on said face.

5. A timekeeping mechanism according to claim 1 wherein said indicia corresponding to minutes within an hour include a numerical indicia for each quarter hour and a non-numerical indicia for each five minute interval.

6. A timekeeping mechanism according to claim 1 wherein said rotary drive element and said face are mounted together on a carriage located atop a base and are movable together with said carriage, and said carriage is movable in rotation relative to said base.

7. In an analog timepiece in which a central primary drive element is mounted perpendicular to a face and is driven at a constant angular velocity relative thereto, the improvement comprising a single hour and minute hand mounted on said primary drive element and extending radially therefrom across said face, a first array of numerical indicia corresponding to hours of time arranged in an inner circular ring about said primary drive element equidistant therefrom at a distance within the length of said single hand, and a second array of indicia corresponding to minutes of time arranged in an outer circular ring in equal repetitive sets at equal angular intervals about said primary drive element and at a distance therefrom greater than said distance of said first array of indicia, whereby said single hard designates both an hour of time and minutes elapsed between said designated hour of time and the next.

8. An analog timepiece according to claim 7 further comprising a plurality of numerical indicia in said first array for each hour of time, whereby said hand passes across a numerical indicia for an hour after initially reaching said hour and before reaching the next hour.

9. An analog timepiece according to claim 8 wherein said hour and minute hand is formed with a loop at a length therealong equal to said distance of said first array of indicia, whereby said loop frames an indicia for an hour as said hand initially reaches a first of said plurality of said numerical indicia for said hour and until said hand reaches an indicia for the next hour.

10. An analog timepiece according to claim 7 wherein each of said sets of said indicia in said second array of indicia include numerical indicia for each fifteen minute interval and non-numerical indicia for each five minute interval.

11. An analog timepiece according to claim 7 further comprising a crown located external to said face in alignment with an indicia in said first array corresponding to a reference hour and a linear, radial reference mark on said face radially aligned with said crown and said central primary drive element.

12. An analog timepiece according to claim 11 further comprising a base and a carriage mounted atop said base and rotatable relative thereto and carrying said crown, said face and said central primary drive element therewith, whereby rotation of said carriage relative to said base alters the orientation of said crown and said radial reference mark relative to said base.

13. Ar analog timepiece according to claim 7 further comprising a secondary drive member which rotates relative to said primary drive member at thirty-six hundred times the speed thereof and further comprising a second hand coupled to said secondary drive element and extending therefrom radially across said face.

14. In a chronometer having a face with a center, and indicia for numbers on said face arranged about said center and corresponding to numerical hours of time, the improvement comprising a single hand for designating both hours and minutes mounted at said center and extending radially therefrom for rotation at a uniform angular velocity relative to said face, and wherein said indicia corresponding to numerical hours are spaced at a first distance from said center and are arranged in an inner circular ring at uniform angular intervals thereabout corresponding to hourly increments, and further comprising indicia corresponding to minutes arranged in an outer circular ring at a second distance from said center greater than said first distance and said indicia corresponding to minutes are repeated within each angular increment corresponding to each hourly increment and said single hand extends radially beyond said indicia corresponding to hours out to said indicia corresponding to minutes.

15. A chronometer according to claim 14 wherein said indicia corresponding to numerical hours of time delineate twelve of said hourly increments and said indicia corresponding to minutes of time designate twelve five minute intervals within each of said hourly increments.

16. A chronometer according to claim 15 wherein said indicia corresponding to numerical hours include four numerical indicia for each hour and all of said numerical indicia for each hour are located within a specific hourly increment corresponding to that hour.

17. A chronometer according to claim 16 wherein said indicia corresponding to minutes include four numerical indicia repeated within each of said hourly increments.

18. A chronometer according to claim 17 wherein said single hard for designating hours and minutes includes a loop therein located at said same first distance from said center as said indicia corresponding to numerical hours, whereby said loop frames said indicia corresponding to numerical hours as said single hand passes thereover.

19. A chronometer according to claim 18 further comprising a radial linear reference indicia on said face designating a reference hour.

20. A chronometer according to claim 14 further comprising a second hand mounted at said center and driven at thirty-six hundred times the angular velocity of said single hand for designating both hours and minutes.

* * * * *